US008167367B1

(12) United States Patent
Martinez

(10) Patent No.: US 8,167,367 B1
(45) Date of Patent: May 1, 2012

(54) SEAT COVER WITH ADJUSTABLE CUSHION APPARATUS

(76) Inventor: Henry Martinez, Fairview, NJ (US)

( * ) Notice: Subject to any disclaimer, the term of this patent is extended or adjusted under 35 U.S.C. 154(b) by 71 days.

(21) Appl. No.: 12/859,384

(22) Filed: Aug. 19, 2010

(51) Int. Cl.
*A47C 7/74* (2006.01)

(52) U.S. Cl. ..... 297/180.12; 297/180.11; 297/217.3

(58) Field of Classification Search ..... 297/180.11, 297/180.12, 217.1, 217.3
See application file for complete search history.

(56) References Cited

U.S. PATENT DOCUMENTS 3,136,577 A * 6/1964 Richard ..... 297/180.11
3,608,964 A 9/1971 Earl
4,165,125 A 8/1979 Owen
5,188,096 A * 2/1993 Yoo ..... 601/57
5,516,189 A * 5/1996 Ligeras ..... 297/180.11
5,613,730 A * 3/1997 Buie et al. ..... 297/180.12
5,920,931 A 7/1999 Zuehlke et al.
6,010,192 A 1/2000 King
6,053,880 A * 4/2000 Sleichter, III ..... 297/217.3
6,951,367 B1 10/2005 Dinnan
7,422,277 B2 * 9/2008 Chen ..... 297/180.12

* cited by examiner

*Primary Examiner* — Anthony D Barfield

(57) ABSTRACT

The seat cover with adjustable cushion apparatus provides for removable fit to a variety of seats. Various sizes and dimensions of the apparatus are provided so that a plurality of seat types and sizes are properly fitted. The apparatus provides a multitude of features and conveniences including seat heating and back massage. The memory hinge importantly provides a user with headrest cushion adjustability whereby the headrest cushion shape is altered and retained thusly until changed again by a user. A user's head can be supported rearwardly and to both sides as tightly or as loosely as a user wishes. The seat back provides for storage of personal items such as cell phone and pencils and the like.

2 Claims, 6 Drawing Sheets

SEAT COVER WITH ADJUSTABLE CUSHION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Not all seats are as comfortable as we might wish, whether car seats, office chairs, or any of a number of other types of seats. Various headrests and other seat cushion options have been provided in the past. The present apparatus provides a unique seat cover that includes a removable headrest with shape memory, along with further comfort features.

FIELD OF THE INVENTION

The seat cover with adjustable cushion apparatus relates to seat covers and headrests and more especially to a combined seat cover with adjustable headrest with memory, and further comfort features.

SUMMARY OF THE INVENTION

The general purpose of the seat cover with adjustable cushion apparatus, described subsequently in greater detail, is to provide a seat cover with adjustable cushion apparatus which has many novel features that result in an improved seat cover with adjustable cushion apparatus which is not anticipated, rendered obvious, suggested, or even implied by prior art, either alone or in combination thereof.

To attain this, the seat cover with adjustable cushion apparatus provides for removable fit to a variety of seats. Various sizes and dimensions of the apparatus are provided so that a plurality of seat types and sizes are properly fitted. As the apparatus provides a multitude of features and conveniences, the location of each is critical to the proper fit and function of the apparatus and all of its features. The memory hinge importantly provides a user with headrest cushion adjustability whereby the headrest cushion shape is altered and retained thusly until changed again by a user. A user's head can be supported rearwardly and to both sides as tightly or as loosely as a user wishes. The seat back importantly provides for storage of personal items such as cell phone and pencils and the like.

Two headrest assembly embodiments are provided. One embodiment allows a user to insert the headrest assembly into existing holes of an existing seat, such as that of a car seat. The second embodiment provides a headrest assembly that removably fits atop a seat having no headrest holes.

Thus has been broadly outlined the more important features of the improved seat cover with adjustable cushion apparatus so that the detailed description thereof that follows may be better understood and in order that the present contribution to the art may be better appreciated.

An object of the seat cover with adjustable cushion apparatus is to removably fit and existing seat.

Another object of the seat cover with adjustable cushion apparatus is to provide added comfort for a seat user.

A further object of the seat cover with adjustable cushion apparatus is to provide a head rest cushion that retains shape until adjusted again.

An added object of the seat cover with adjustable cushion apparatus is to provide a heated seat bottom.

And, an object of the seat cover with adjustable cushion apparatus is to provide massage within the seat back.

An additional object of the seat cover with adjustable cushion apparatus is to provide a pivotally disposed table.

Yet another object of the seat cover with adjustable cushion apparatus is to provide storage pockets.

Yet another object of the seat cover with adjustable cushion apparatus is to support the head and neck in the event of an automobile impact.

These together with additional objects, features and advantages of the improved seat cover with adjustable cushion apparatus will be readily apparent to those of ordinary skill in the art upon reading the following detailed description of presently preferred, but nonetheless illustrative, embodiments of the improved seat cover with adjustable cushion apparatus when taken in conjunction with the accompanying drawings.

In this respect, before explaining the current embodiments of the improved seat cover with adjustable cushion apparatus in detail, it is to be understood that the seat cover with adjustable cushion apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved seat cover with adjustable cushion apparatus. It is therefore important that the claims be regarded as including such equivalent constructions insofar as they do not depart from the spirit and scope of the seat cover with adjustable cushion apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the seat cover with adjustable cushion apparatus generally designated by the reference number 10 will be described.

Figure 1:
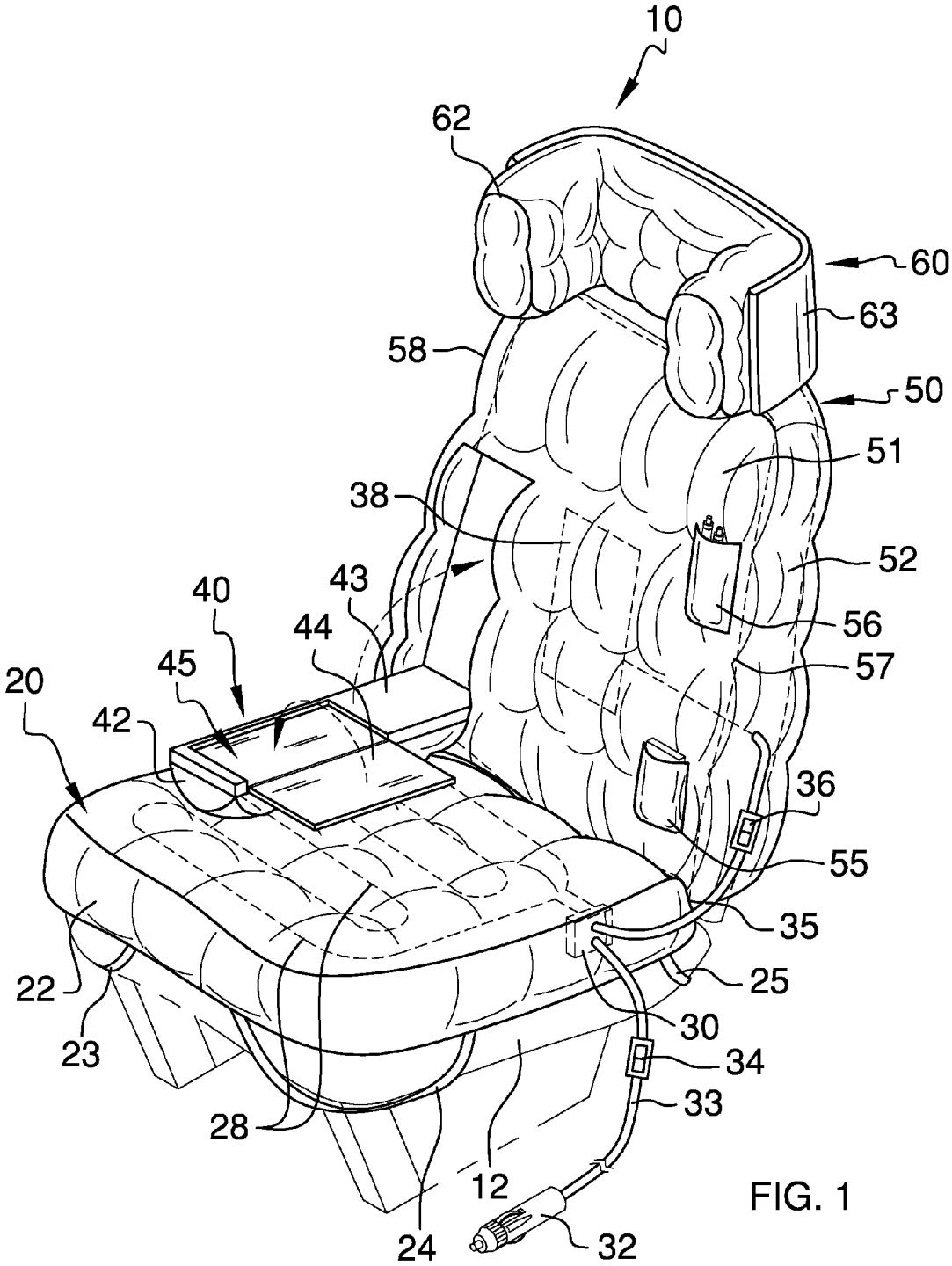
FIG. 1 is a perspective view of the apparatus fitted to a seat.
Figure 2:
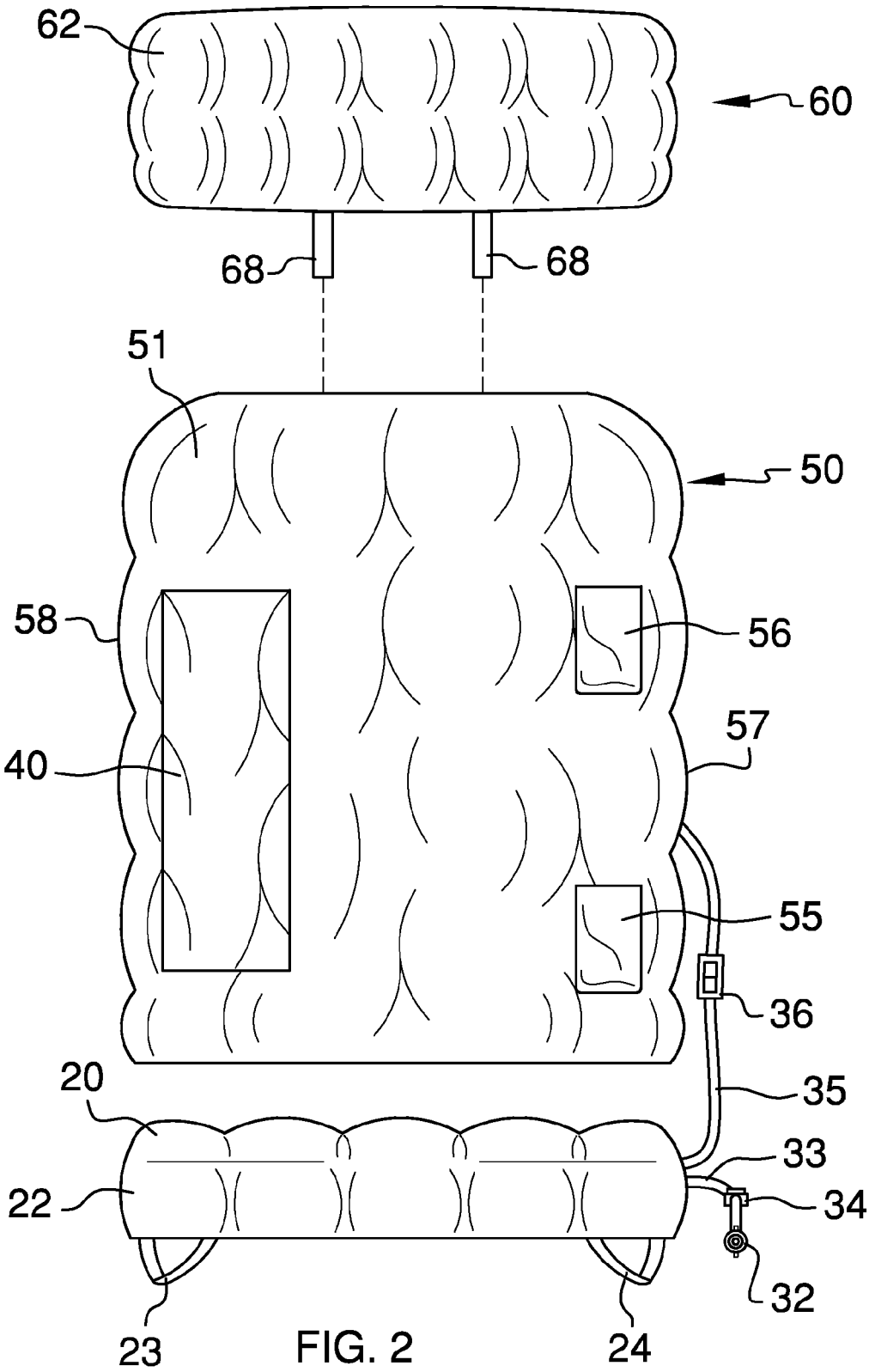
FIG. 2 is a front elevation view.

Referring to FIGS. 1 and 2, the apparatus 10 partially consists of the seat bottom 20 having a downwardly disposed bottom surround 22. The seat bottom 20 is removably fitted to an existing seat 12. The quartet of spaced apart elastic straps is affixed to the bottom surround and removably holds the seat bottom to an existing seat 12.

Figure 3:
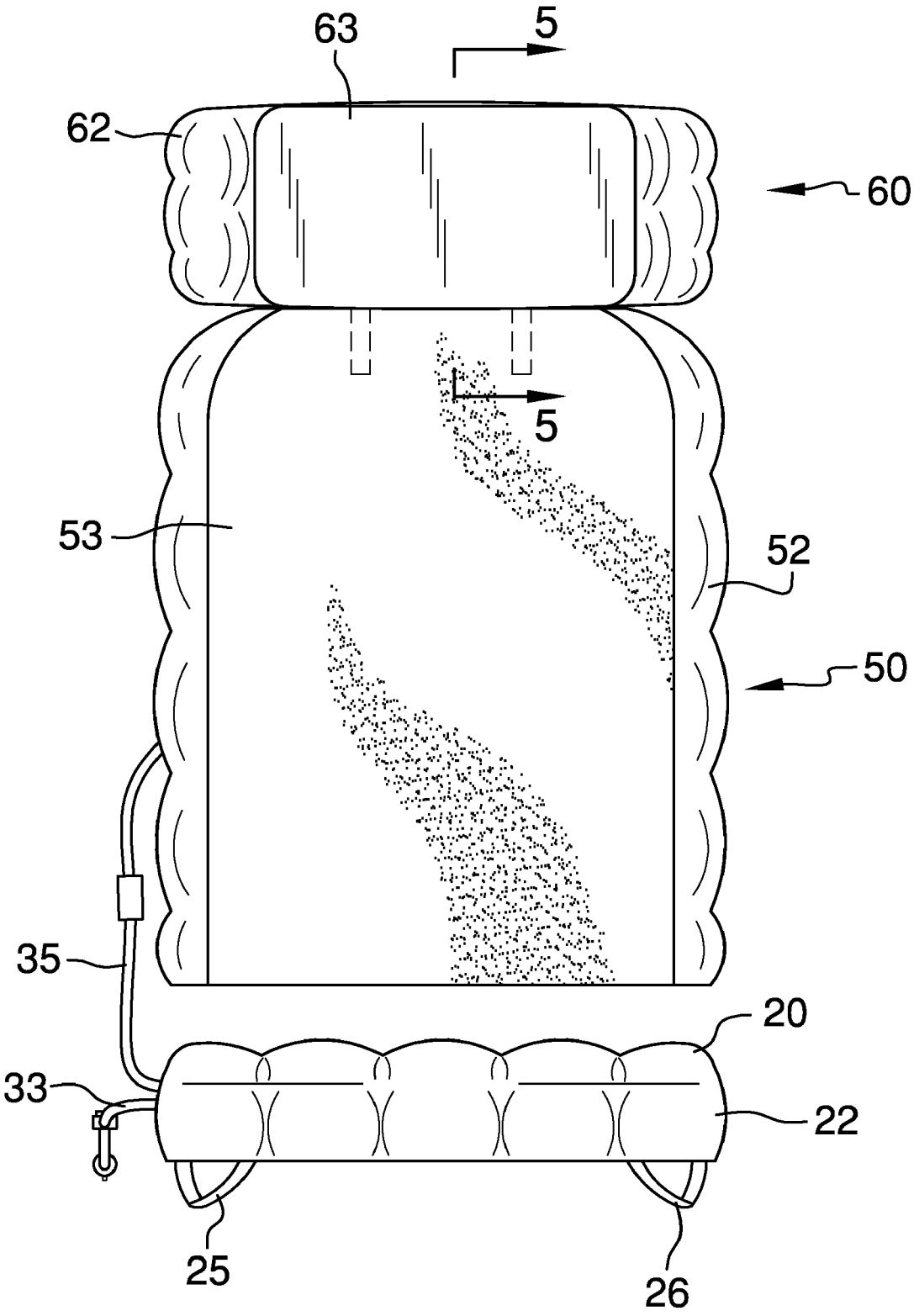
FIG. 3 is a rear elevation view.

Continuing to refer to FIGS. 1 and 2 and referring also to FIG. 3, the straps comprise the first strap 23, the second strap 24, the third strap 25, and the fourth strap 26. The plurality of heating coils 28 is disposed within the seat bottom 20. The electrical junction 30 is disposed within the seat bottom 20. The electrical junction 30 is in communication with the heating coils 28. The first cord 33 is extended from the electrical junction 30 and through the bottom surround 22. The first cord 33 further comprises a cigar plug 32.

The first inline switch 34 is disposed within the first cord 33. The first inline switch 34 is in communication with the electrical junction 30, whereby the heating coils 28 are switched on and off. The elastic seat back 50 has a front 51 spaced apart from a back 53 by the border 52. The border 52 surrounds two sides and a top of an existing seat 12. The seat back 50 further comprises a left side 57 spaced apart from a right side 58 by the seat back 50. The seat back 50 is removably fitted to an existing seat 12. The massage member 38 is disposed within the seat back 50 front 51. The second cord 35 is in communication with the massage member 38 and the electrical junction 30. The second cord 35 is extended from the seat back 50 left side 57 border 52. The second inline switch 36 is disposed within the second cord 35, and the massage member 38 thereby turned on and off.

Referring again to FIGS. 1 and 2, the first storage pocket 55 is disposed in the seat back 50 front 51 downwardly adjacent to the left side 57. The second storage pocket 56 is disposed in the seat back 50 front 51. The second storage pocket 56 is spaced apart from and disposed directly above the first storage pocket 55. The pockets are importantly disposed laterally, adjacent to the left side 57 so that a user's comfort is not disturbed. The downwardly pivoting table 40 is disposed in the seat back 50 front 51 adjacent to the right side 58. The table 40 further importantly comprises the flat top 43 disposed opposite the semicircular bottom 42. The hinged table extension 44 is folded out medially from the flat top 43. The hinged table extension 44 importantly does not extend fully across the flat top 43. The hinged table extension 44 and a part of the flat top 43 importantly form a coplanar surface 45.

Figure 4:
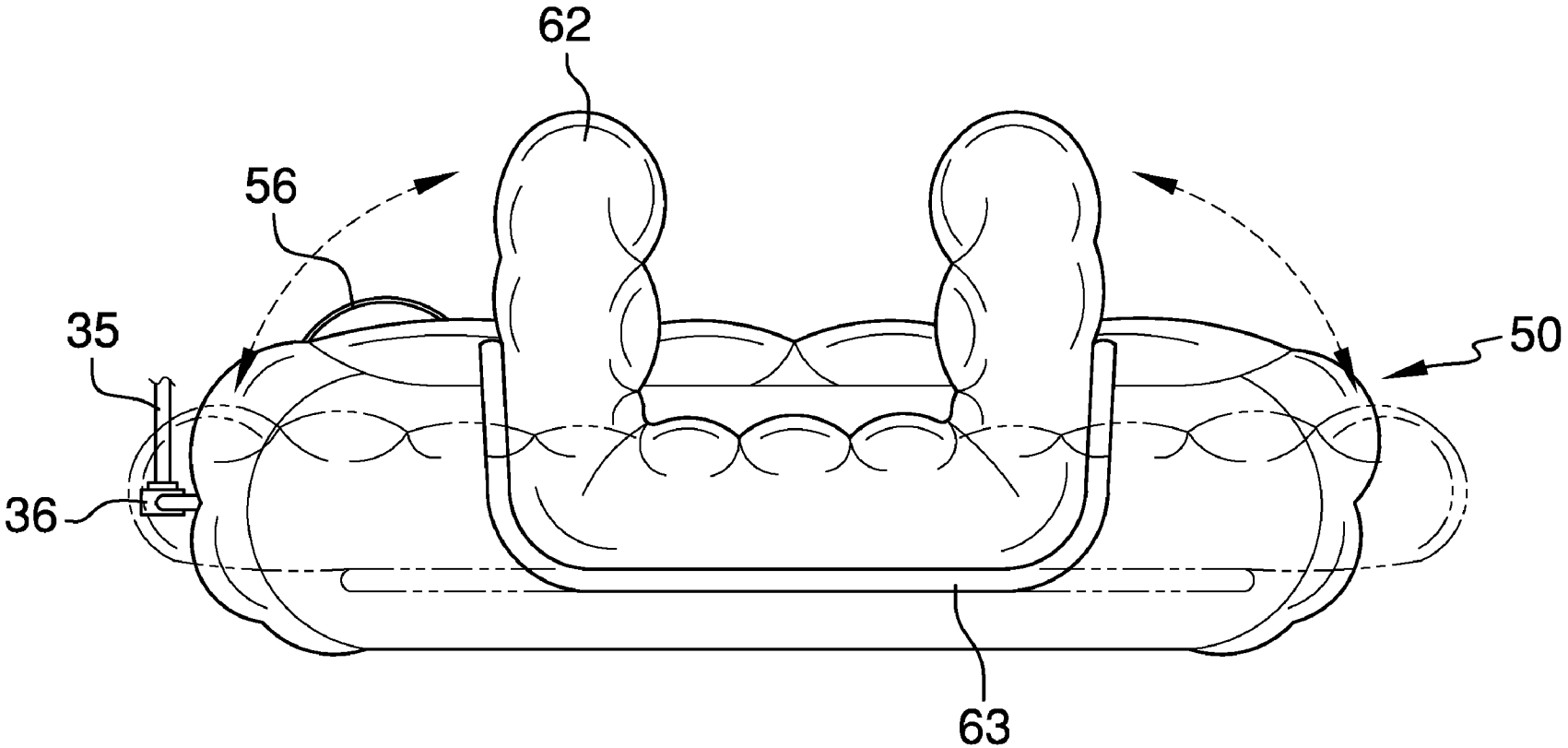
FIG. 4 is a top plan view.
Figure 5:
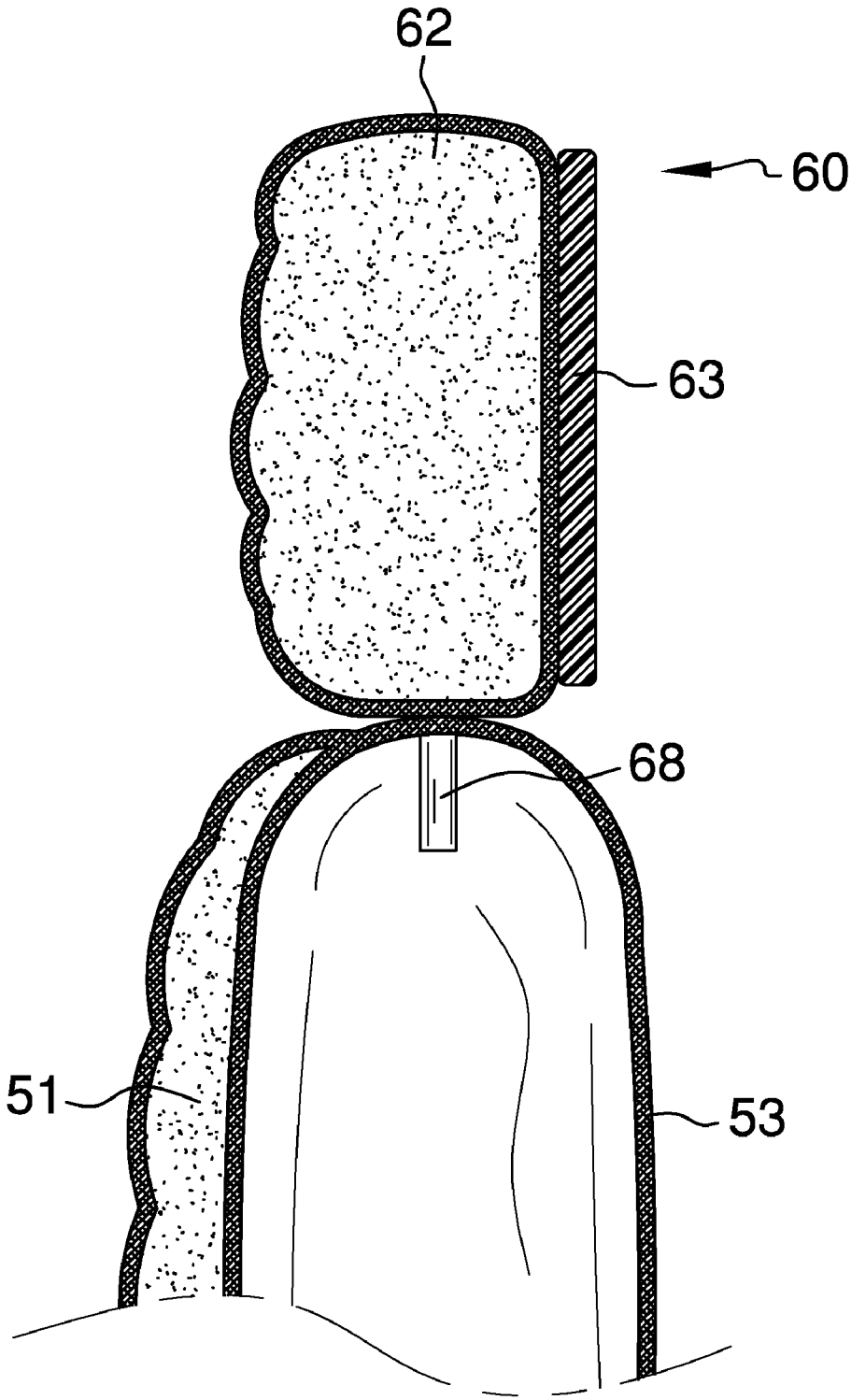
FIG. 5 is a partial cross sectional view of FIG. 3, taken along the line 5-5.

Referring to FIGS. 3, 4, and 5, the headrest assembly 60 is removably disposed atop the seat back 50. The headrest assembly 60 further comprises the frontally disposed cushion 62. The memory hinge 63 substantially surrounds the cushion 62 rearwardly. The memory hinge 63 is a critical feature as the cushion 62 is adjusted by a user to the shape desired and that shape retained by the memory hinge 63 until again altered. The pair of spaced apart down rods 68 is disposed downwardly on the cushion 62. The down rods 68 are removably inserted into the upwardly disposed seat back 50 border 52.

Figure 6:
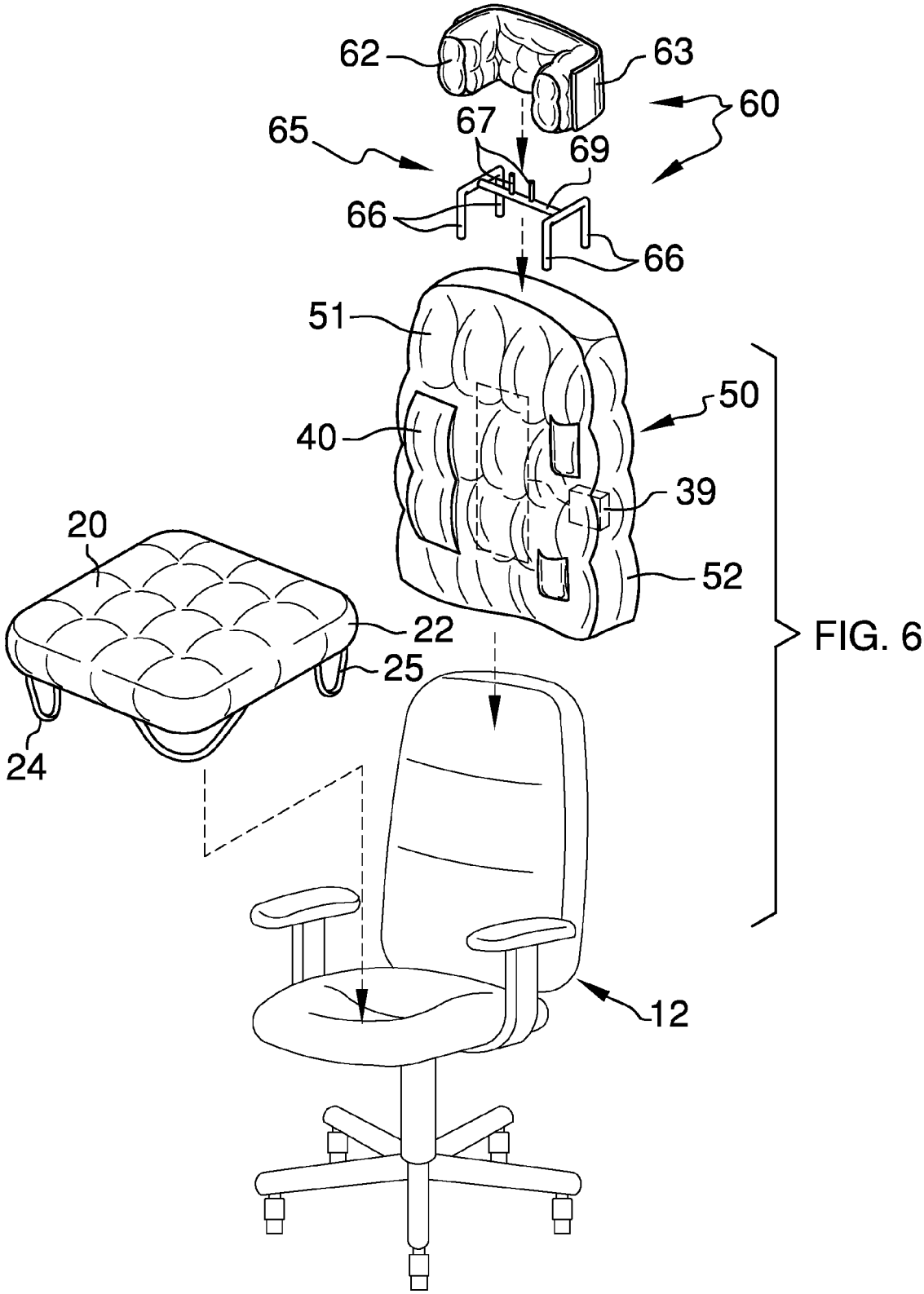
FIG. 6 is a perspective view having an alternate headrest assembly.

Referring to FIG. 6, the alternate embodiment of the headrest assembly 60 is removably disposed atop the seat back of the existing seat 12. The headrest assembly 60 further comprises the frontally disposed cushion 62 with the memory hinge 63 substantially surrounding the cushion 62 rearwardly. The bracket 65 is partially comprised of the pair of spaced apart upward projections 67 removably inserted into the cushion 62. The crosspiece 69 supports the upward projections 67. The quartet of spaced apart surround rods 66 is extended downwardly from the crosspiece 69. The surround rods 66 removably surrounding an existing back of an existing seat 12 to thereby retain the headrest assembly 60. The massage member 38 is disposed within the seat back 50 front 51. The switched battery pack 39 is disposed within the seat back 50. The battery pack 39 is in communication with the massage member 38.

With respect to the above description then, it is to be realized that the optimum dimensional relationships for the parts of the seat cover with adjustable cushion apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the seat cover with adjustable cushion apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the seat cover with adjustable cushion apparatus may be used.

Therefore, the foregoing is considered as illustrative only of the principles of the seat cover with adjustable cushion apparatus. Further, since numerous modifications and changes will readily occur to those skilled in the art, it is not desired to limit the seat cover with adjustable cushion apparatus to the exact construction and operation shown and described, and accordingly, all suitable modifications and equivalents may be resorted to, falling within the scope of the seat cover with adjustable cushion apparatus.

What is claimed is:

1. A seat cover with adjustable cushion apparatus consisting of, in combination:

a seat bottom having a downwardly disposed bottom surround, the seat bottom and surround removably fitted to an existing seat;

a quartet of spaced apart elastic straps affixed to the bottom surround, the straps removably holding the seat bottom to the existing seat, the straps comprising a first strap, a second strap, a third strap, and a fourth strap;

a plurality of heating coils disposed within the seat bottom;

an electrical junction disposed within the seat bottom, the electrical junction in communication with the heating coils;

a first cord extended from the electrical junction and through the bottom surround, the first cord further comprising a cigar plug;

a first inline switch disposed within the first cord, the first inline switch in communication with the electrical junction, whereby the heating coils are switched on and off;

an elastic seat back having a front spaced apart from a back by a border, a left side spaced apart from a right side, the seat back removably fitted to an existing seat;

a massage member disposed within the seat back front;

a second cord in communication with the massage member and the electrical junction, the second cord extended from the seat back left side border;

a second inline switch disposed within the second cord, whereby the massage member is turned on and off;

first storage pocket disposed in the seat back front downwardly adjacent to the left side;

a second storage pocket disposed in the seat back front, the second storage pocket spaced apart from and disposed directly above the first storage pocket;

a downwardly pivoting table disposed in the seat back front adjacent to the right side, the table further comprising:

a flat top;

a hinged table extension folded out medially from the flap top, the extension and a part of the flat top forming a coplanar surface;

a semicircular bottom;

a headrest assembly removably disposed atop the seat back, the headrest assembly further comprising:

a frontally disposed cushion a memory hinge substantially surrounding the cushion rearwardly;

a pair of spaced apart down rods disposed downwardly on the cushion, the down rods removably inserted into the upwardly disposed seat back border.

2. A seat cover with adjustable cushion apparatus consisting of, in combination:

a seat bottom having a downwardly disposed bottom surround, the seat bottom removably fitted to an existing seat;

a quartet of spaced apart elastic straps, the straps removably holding the seat bottom to the existing seat, the straps comprising a first strap, a second strap, a third strap, and a fourth strap;

a plurality of heating coils disposed within the seat bottom;

an electrical junction disposed within the seat bottom, the electrical junction in communication with the heating coils;

an elastic seat back having a front spaced apart from a back by a border, a left side spaced apart from a right side, the seat back removably fitted to an existing seat;

a massage member disposed within the seat back front;

a switched battery pack disposed within the seat back, the battery pack in communication with the massage member;

first storage pocket disposed in the seat back front downwardly adjacent to the left side;

a second storage pocket disposed in the seat back front, the second storage pocket spaced apart from and disposed directly above the first storage pocket;

a downwardly pivoting table disposed in the seat back front adjacent to the right side, the table further comprising:

a flat top;

a hinged table extension folded out medially from the flap top, the extension and a part of the flat top forming a coplanar surface;

a semicircular bottom;

a headrest assembly removably disposed atop the seat back, the headrest assembly further comprising:

a frontally disposed cushion a memory hinge substantially surrounding the cushion rearwardly;

a pair of spaced apart upward projections removably inserted into the cushion;

a crosspiece supporting the upward projections;

a quartet of spaced apart surround rods extended downwardly form the crosspiece, the surround rods removably surrounding an existing back of an existing seat.

* * * * *